United States Patent [19]

Vogel

[11] 4,356,703

[45] Nov. 2, 1982

[54] REFRIGERATION DEFROST CONTROL

[75] Inventor: Kenneth E. Vogel, Mound, Minn.

[73] Assignee: McQuay-Perfex Inc., Minneapolis, Minn.

[21] Appl. No.: 174,243

[22] Filed: Jul. 31, 1980

[51] Int. Cl.[3] ..... F25D 21/06; F25B 47/00

[52] U.S. Cl. ..... 62/155; 62/196 B; 62/234; 62/278

[58] Field of Search ..... 62/234, 155, 278, 196 B, 62/81, 524, 525

[56] References Cited

U.S. PATENT DOCUMENTS

| | | | |
|---|---|---|---|
| 2,139,297 | 12/1938 | Bergdoll | 62/524 |
| 3,273,635 | 9/1966 | Jobes | 62/155 |
| 3,453,838 | 7/1969 | Decker et al. | 62/155 |
| 4,122,686 | 10/1978 | Lindahl et al. | 62/278 |
| 4,122,688 | 10/1978 | Mochizuki et al. | 62/278 |

*Primary Examiner*—Albert J. Makay
*Assistant Examiner*—Harry Tanner
*Attorney, Agent, or Firm*—Merchant, Gould, Smith, Edell, Welter & Schmidt

[57] ABSTRACT

An improved system for control of defrost in a refrigeration system of the type wherein one or more evaporators are defrosted by hot gas from the compressor while one or more evaporators remain in refrigeration operation. Prior to operating diverting valves to establish defrosting gas flow in an evaporator, a liquid line valve is closed and the system is pumped down to a predetermined amount of refrigerant charge in the defrost loop. In a preferred embodiment, this is accomplished by first opening the liquid line valve to flood the system, then closing it for a predetermined time interval to pump down to the predetermined amount of charge prior to operating the diverting valves. The predetermined amount of refrigerant charge in the defrost loop, together with a flow through defrost receiver incorporated in the defrost loop assures optimum efficiency by avoiding situations of two little or too much charge in the defrost loop, either of which would impair efficiency of the defrosting and the ongoing refrigeration in the other evaporator or evaporators.

8 Claims, 3 Drawing Figures

POWER
TIMER MOTOR
RESET
RESET
DELAY
3 MIN.
DELAY
45 SEC.
DELAY
1 MIN.

REFRIGERATION DEFROST CONTROL

TECHNICAL FIELD OF THE INVENTION

The present invention pertains to refrigeration systems employing hot gas defrosting, and control systems therefor. Specifically, the invention relates to improvements in the type of refrigeration defrost system wherein at least one evaporator is defrosted by hot gas while one or more evaporators remain in refrigeration operation.

BACKGROUND OF THE PRIOR ART

One well established method of defrosting evaporators in refrigeration systems is by forcing hot gas from the compressor of the system through the evaporator so that the evaporator acts as a condenser. The heat given up by the evaporator under those conditions melts the ice and frost that has formed on the evaporator coils and fins during normal refrigeration operation. Typically the hot gas defrosting is accomplished by diverting valves in the refrigerant path which are switched to accomplish defrosting mode to divert the hot gas through the evaporator, either in the same direction as the refrigerant flow during refrigeration, or in the opposite direction. The defrosting can be accomplished on a time basis so that a defrost cycle is run at selected intervals, or it can be done on a demand basis through the use of frost sensors and the like for detecting frost buildup on the evaporator coils.

While hot gas defrosting has proved to be very useful and advantageous, there may be certain areas in which problems can occur in practice which can lead to faulty operation or less than optimum efficiency.

The present invention provides improved control over several areas of the hot gas defrosting process so as to provide efficient defrosting at a high speed and with little or no waste of energy on the defrosting process. Preferably the invention is used in conjunction with restricting the refrigeration system during a defrost cycle by switching the condenser and perhaps other components out of the refrigerant path. By thus restricting the system, all heat absorbed by the refrigerating evaporator or evaporators is used in the defrosting process. This helps to provide maximum speed of defrosting and maximum energy efficiency, so there is little or no waste heat. The control system of the present invention operates to provide the correct amount of refrigerant charge in the operating part of the system during the defrost cycle. This is important because if there is too little charge in the operating portion, there may not be enough refrigerant to maintain the refrigerating process, without which it is not possible to get a good defrost process for the defrosting evaporator or evaporators. This would mean a low energy efficiency and a corresponding waste of energy and money. If the charge in the operating portion during defrost is extremely low, there may not be any defrosting operation at all.

On the other hand, if there is too much refrigerant charge in the operating part of the system during a defrost cycle, this could lead to problems. The excess refrigerant would tend to collect as liquid in areas of the defrosting evaporator which are to be defrosted, and this liquid collection would prevent hot gas from flowing through those areas of the evaporator and would prevent defrosting. The result would be slow and incomplete defrosting. A further problem that can be aggravated by excess refrigerant charge in the defrosting loop is that after the completion of the defrost cycle, when the diverting valves, etc. are switched back to normal refrigeration mode, this may result in slug back of liquid refrigerant into the suction line which could cause damage to the compressor. In some prior art systems it has been necessary to introduce an accumulator in the suction line in order to trap such liquid refrigerant to prevent slug back at the end of defrost. This need is eliminated in the present invention, wherein the control system effectively determines where the liquid refrigerant will be within the system and controls the transition from defrost mode back to refrigeration mode in order to prevent the liquid refrigerant from entering the suction line.

Improvements in the design of the evaporators in terms of refrigerant path circuiting and valving control can advantageously be used with the above improvements in defrost cycle control, to achieve improved speed and uniformity in the defrosting of the evaporators. These features and advantages are pointed out in greater detail with reference to the description of the preferred embodiment herein.

SUMMARY OF THE INVENTION

According to the present invention, there is provided an improved defrost control system for a refrigeration system of the type which includes a compressor, a condenser, at least two evaporators, and interconnecting conduits to form refrigerant flow paths through the system. A liquid line valve is provided in the refrigerant path between the condenser and the evaporators, and diverting valve means are provided for selectively establishing, in conjunction with the liquid valve means, a defrost loop through at least one evaporator whereby hot gas is introduced through the defrosting evaporator, where it is condensed to form liquid refrigerant which then continues through at least one evaporator which remains in refrigeration mode. Control means are provided for controlling the operation of the liquid line valve and the diverting valve means, so that to begin a defrost cycle the liquid line valve is closed to allow the system to pump down to a predetermined amount of refrigerant charge in the defrost loop, at which point the diverting valve means are operated to establish refrigerant flow through the defrost loop.

According to a preferred embodiment, a defrost receiver is provided between the liquid line valve and the evaporators, to serve as a temporary storage reservoir for the liquid condensed by the defrosting evaporator, and to serve as a source for the refrigerating evaporator or evaporators.

According to a preferred embodiment, the control means is adapted to temporarily open the liquid line valve prior to a defrost cycle, as it may otherwise be operating under thermostatic control, to assure that there will be more than an adequate supply of refrigerant in the defrost loop. The valve is then closed for pump down to bring the defrost loop down to the correct amount of refrigerant charge for defrost.

DETAILED DESCRIPTION OF THE PREFERRED EMBODIMENT

Figure 1:
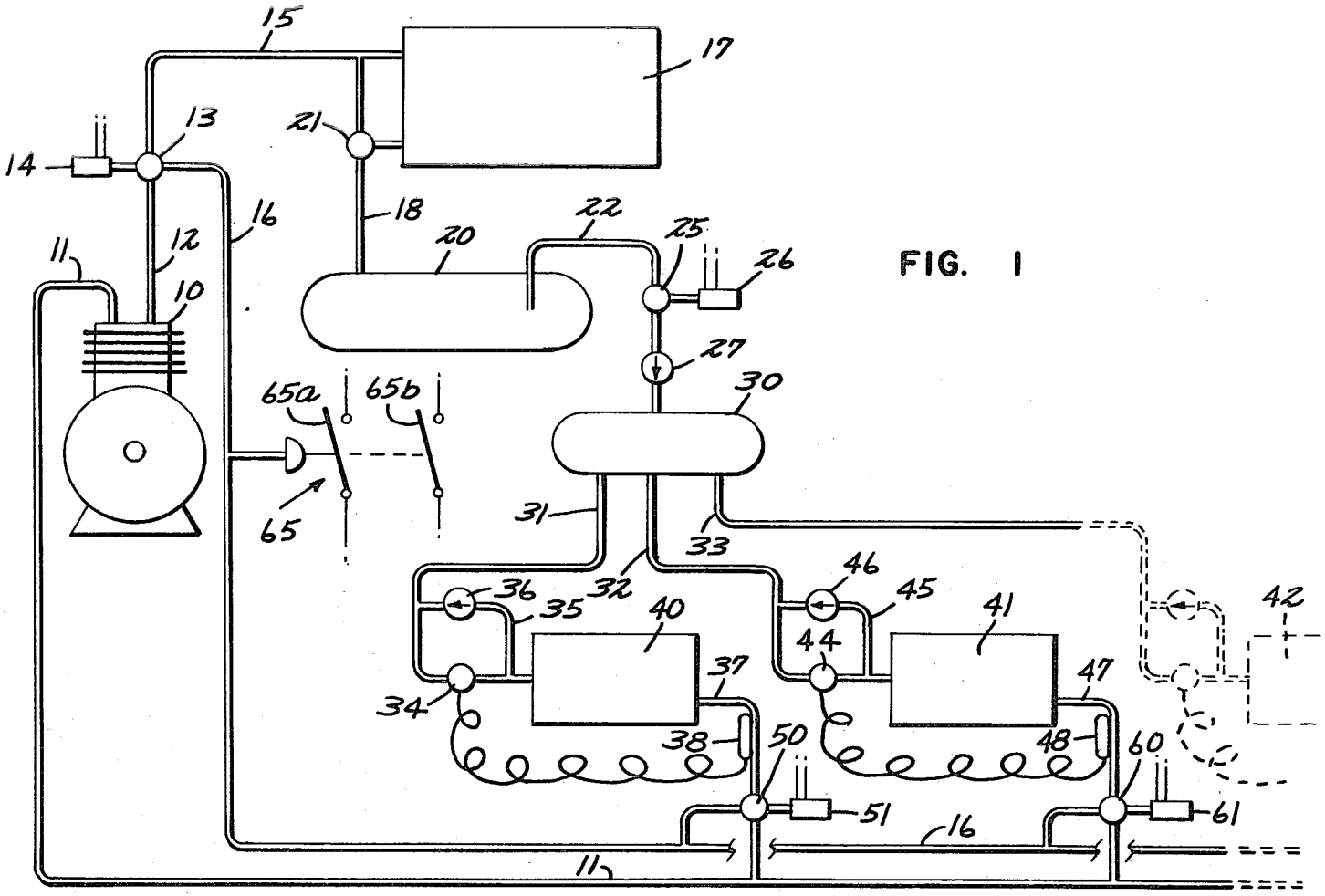
FIG. 1 is a schematic diagram of a refrigerant system with improved hot gas defrost control according to the present invention.

In FIG. 1, reference number 10 designates the compressor of the refrigeration system. It is connected to receive a suction line 11 which is connected to its intake, and a discharge line 12 which is connected to the outlet of the compressor. The compressor is driven by an electrical motor and incorporates a control for starting and stopping the compressor based upon pressure in the suction line, as is conventional in refrigeration systems. In practice, the compressor can be a single unit, or a plurality of units as required by capacity considerations for the system, and a sequencing control can be used as is generally known in the art for matching compressor capacity to system requirements in the case of multiple compressors.

Discharge line 12 connects to a three-way diverting valve 13, which is controlled by electrical control 14. Hot gas refrigerant in discharge line 12 passes through valve 13 either to line 15 or line 16, depending upon the position of the valve. Line 15 connects to condenser 17, which may be any type of known condenser or a plurality of interconnected condensers which may be mounted on roof top remote from the rest of the system. The outlet of condenser 17 connects through line 18 to receiver 20. Optionally, the improved head pressure control of U.S. Pat. No. 4,136,528, assigned to the same assignee as the present invention, can be used in conjunction with the refrigeration system, in which case a control valve 21 and controls therefor as set forth in the above-mentioned patent can be incorporated. In that case control valve 21 would connect between the outlet of condenser 17, line 18, and a bypass branch of line 15 for control of system head pressure by control of condenser flooding.

Line 22 conveys liquid refrigerant from receiver 20 to liquid line shutoff valve 25, which is operated by solenoid 26. Valve 25 is connected to check valve 27 which in turn connects to defrost receiver 30. Liquid lines for the evaporators connect from defrost receiver 30. In FIG. 1, these liquid lines are number 31, 32, and 33, it being understood that the number of such lines would correspond to the number of evaporators in a given system. In FIG. 1, two evaporator loads 40, 41 are shown, and a third evaporator 42 is shown in broken lines to indicate that additional evaporator loads can be connected depending upon system size, as the invention is not limited to any paticular number of evaporators.

Liquid line 31 connects to thermostatic expansion valve (TEV) 34, and the output of valve 34 connects to evaporator 40. A branch 35 connects back through check valve 36 to liquid line 31, for use during defrost mode. The outlet of evaporator 40 is connected to line 37, and sensing bulb 38 for TEV 34 is placed in contact with the refrigerant at the evaporator outlet as is conventional.

Liquid line 37 connects to a three-way diverting valve 50 which is operated by electrical control 51. One part of diverting valve 50 connects to line 16, and the other part connects to the suction line 11.

Evaporator 41 is similarly connected from liquid line 32 by means of TEV 44, branch 45, and check valve 46. The outlet of evaporator 41 connects via line 47 to three-way diverting valve 60, the other parts of which connect to line 16 and suction line 11. Valve 60 is operated by electrical control 61. Sensing bulb 48 for TEV 44 is in contact with line 47. In the case of one or more additional evaporators, similar components and connections would be made to receiver 30 and to lines 11 and 16.

A pressure limit switch 65 is included in line 16, and it consists of a pressure responsive element connected to control a pair of switch contacts **65*a* and 65*b***.

The system of FIG. 1 thus described provides a refrigerant flow path during normal refrigeration from compressor 10, through condenser 17 (or bypassing condenser 17 under control valve 21, is applicable), through receivers 20 and 30 to the evaporators. Vapor from the evaporators is returned through suction line 11 to the compressor 10. In defrosting mode, deverting valve 13 and liquid line shutoff valve 25 are operated to restrict the system and to temporarily cut condenser 17 and receiver 20 out of the refrigerant path. Check valve 27 restricts backflow into the receiver, since typically solenoid valves restrict flow in only one direction. Hot gas then proceeds through line 16 to flow in reverse direction through the evaporator or evaporators being defrosted. For example, if evaporator 40 is being defrosted, diverting valve 50 would be actuated to conduct hot gas from line 16 through evaporator 40, where it is condensed, thereby giving up heat to defrost the evaporator. Liquid refrigerant passes into defrost receiver 30, from where it is fed to one or more evaporators that remain in refrigeration mode. It is important that at least one evaporator remain in normal refrigerating mode, so that the defrosting evaporator or evaporators acts as a condenser for the refrigerant to be utilized in the evaporator or evaporators that remain in refrigeration mode, as refrigerant is cycled through the restricted operating part of the system. In the case of a two evaporator system, one would be in defrost while the other remains in refrigeration mode. In the case of larger systems, multiple evaporators could be in defrost and refrigeration mode.

Although FIG. 1 in the preferred embodiment is described in terms of hot gas flow path through the defrosting evaporator in a direction opposite to the path of flow of refrigerant during refrigeration mode, it will be understood that the direction of flow during defrost is not critical, and by suitable valving modifications, could be through the evaporators in the same direction as refrigeration mode flow. Also, while branches 35, 45, and corresponding check valves 36, 46 are used as the refrigerant flow path around the TEV's 34, 44 during defrost mode, they are not essential, and probably could be omitted. This is because the sensing bulb for the TEV of the defrosting evaporator will be very hot, causing its TEV to be wide open, which would probably provide a sufficient flow path from the evaporator back to the defrost receiver 30, depending upon the particular design of the TEV. Of course if a branch such as 35 or 45 is used as a refrigerant path during defrost, a check valve must be used in order to prevent unwanted flow through the branch during normal refrigeration mode. The above generally describes the operation of the systems of FIG. 1 in refrigeration and defrost modes. However, the careful control of the transition between these two modes is an important feature of the present invention, and this will best be understood with reference to the control system of FIG. 2.

Figure 2:
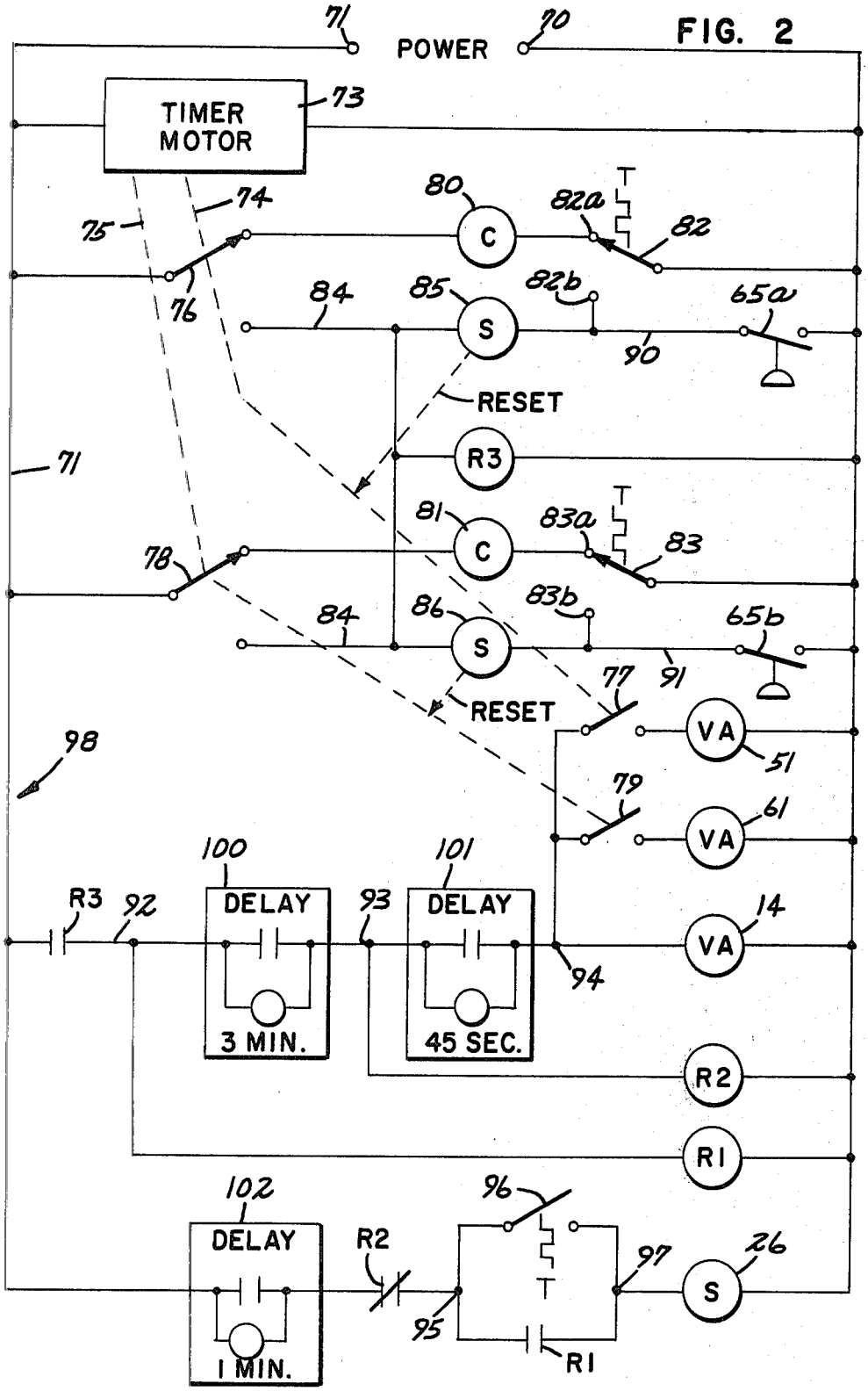
FIG. 2 is an electrical diagram of the control system for the defrost control of the system of FIG. 1.

In FIG. 2, a source of electrical power is applied to terminals 70, 71. In the embodiment shown, defrost is controlled on a time basis whereby defrosting of the individual evaporators is initiated on a programmed time sechedule. However, initiation of defrost cycles could be established on a demand basis as is generally known in the art, through use of frost sensors on the evaporators. In FIG. 2, timer motor 73 is connected to the power supply and operates through mechanical linkages, suggested by broken lines 74, 75 to operate sets of switches. Specifically, single pole double throw switch 76 and single pole single throw switch 77 are operated by the motor through linkage 74, and single pole double throw switch 78 and single pole single throw switch 79 are operated by linkage 75. The poles of switches 76 and 78 are connected to power line 71. The normally closed terminal of switch 76 connects to contactor 80 which controls the energization for the fan motors (not shown) for evaporator 40. The other side of contactor 80 connects through a thermostat 82, the pole of which connects to power lead 70. Thermostat 82 is connected to evaporator 40, and is used to sense completion of defrosting of evaporator 40, and to terminate the defrost cycle.

In similar manner, the normally closed contact of switch 78 connects to contactor 81 and thermostat 83 for evaporator 41.

The normally open contacts of switches 76 and 78 connect to lead 84, a branch of which connects to the relay driver R3, the other side of which connects to power lead 70. Another branch of lead 84 connects to reset solenoid 85 which is mechanically coupled to reset switches 76 and 77. A further branch of lead 84 connects to reset solenoid 86 which is mechanically coupled to reset switches 78 and 79.

The other side of solenoid 85 connects to lead 90, a branch of which connects to another contact **82*b* of thermostat 82, and a branch of which connects to pressure limit switch 65*a***.

In similar manner, the other side of reset solenoid 86 connects to lead 91, a branch of which connects to contact **83*b* of thermostat 83, and another branch of which connects to a pressure limit switch 65*b***.

Normally open relay contacts R3, which are operated by relay driver R3, connect to power lead 71 and to a lead indicated by reference number 92. One branch of lead 92 connects to relay driver R1, the other side of which is connected to power lead 70. The normally open contacts for this relay are labeled R1, the corresponding designations are used for the other relays in the circuit.

A plurality of time delay relays 100, 101, and 102 are used in FIG. 2. These are self-contained devices, electronically operated, which function to close their switching contacts following a predetermined time delay from the time that power is first applied across the device. Such units are generally known and available in the prior art. Alternatively, thermal type time delay relays could be used. Time delay device 100 connects between leads 92 annd 93, and delay device 101 connects between leads 93 and 94. A branch of lead 93 connects to relay driver R2, the other side of which connects to power lead 70. A branch of lead 94 connects to valve actuator 14 for three-way diverting valve 13. Other branches of lead 94 connect to switches 77 and 79. Valve actuators 51 and 61 connect respectively from switches 77 and 79 to power lead 70, for controlling three-way diverting valves 50 and 60, respectively.

Delay device 102 connects from lead 71 to normally closed contacts R2. The other side of contacts R2 connects to lead 95, one branch of which connects to contacts R1, and the other branch of which connects to thermostat 96, which is the room or cold box thermostat for the refrigerated space. The other side of thermostat 96 and contacts R1 connect via lead 97 to solenoid 26 which operates liquid line shutoff valve 25 of FIG. 1. If a manual on-off switch for the entire system is desired, it can be placed in lead 71 at the point indicated by reference number 98, which will function to de-energize solenoid 26 and shut off the liquid line.

In normal refrigeration mode, valve actuators 51, 61 and 14 are de-energized, and solenoid 26 is energized to hold open the liquid line. When the solenoid valve is de-energized, valve 25 shuts off the liquid line.

A defrost cycle is initiated by timer motor 73 reaching a position to actuate the switches for one of the evaporators, although as pointed out above, suitable deman controls could be used instead. The time schedule for the frequency of defrost intervals may be programmed to a suitable selection of timer motor 73, as is generally known in the art, in consideration of the anticipated or observed frost buildup rates on the evaporators in a given installation. Assume for purposes of illustration that the time for defrost of evaporator 40 occurs. Switches 76 and 77 are actuated. This de-energizes contactor 80 for the fans for evaporator 40, since it is desired that the evaporator fans be off during defrost mode. At the same time, the circuit is completed from lead 71 to lead 84, energizing relay R3. Note that reset solenoid 85 will in general not be actuated at this time, since thermostat 82 will be cold, having been in refrigeration mode, and because switch contact **65*a* will be open in the absence of some sort of failure causing abnormal high pressure in line 16**.

Just prior to the initiation of the defrost cycle, liquid line shutoff valve 25 might be open or closed, since it is operating under control of thermostat 96. The first step upon initiation of the defrost cycle is to make sure the liquid line solenoid is open for a period of time, usually several minutes, so that there will be more than adequate refrigerant in the defrost loop at the time the actual defrosting mode takes place. This is accomplished by closing contacts R1, which occurs when contacts R3 are closed. This closes the circuit from power lead 70, through solenoid driver 26, contacts R1, normally closed contacts R2 to delay device 102, which after its delay period, will complete the circuit to power lead 71. Actually, the delay provided by delay device 102 is not needed at this point, and could be bypassed by additional relay logic if desired. However the delay provided by device 102 is used upon re-energizing of solenoid 26 at the end of defrost, as it will be explained in more detail below, and for simplicity and convenience it is allowed to provide its delay at any time solenoid 26 is to be energized. The time delay of device 102 must be much shorter than the delay of device 100 for proper operation. In a preferred embodiment using two evaporators, delay device 100 was chosen for three minutes, and delay device 102 was chosen for one minute. This is to allow sufficient time for refrigeration to continue with liquid line shutoff valve 25 open so that there will be more than adequate refrigerant in the defrost loop.

The next step is to close liquid line shutoff valve 25 and initiate a controlled partial pump down of the system downstream of that valve prior to fully switching to defrost mode. This is accomplished by delaying the switching of the diverting valves until the system that will be included in the defrost loop is pumped down to the optimum amount of refrigerant charge. In the preferred embodiment this is accomplished by a time delay for the switching of diverting valves 13 and 50 or 60 for a time interval following the closing of liquid line shutoff valve 25. This is accomplished by the opening of relay contacts R2 at the end of the three minute delay of device 100 which shuts off the liquid line, and initiates the time delay of device 101 which, in the two evaporator embodiment mentioned above, is 45 seconds. The exact duration of this pump down period would be calculated or empirically determined based upon the coil size and refrigerating rate for the coils. This empties the defrost receiver 30 down to the optimum amount of charge for the defrost loop. At the end of the delay provided by device 101, its contacts are closed, completing the circuit through to diverting valve actuators 14 and 51. This causes the condenser and receiver 20 to be cut off, and the discharge of compressor 10 to proceed through line 16, valve 50 and line 37 to evaporator 40. The hot gas melts the frost buildup on the evaporator coils while it is being condensed to liquid form. The liquid refrigerant proceeds through line 31 to defrost receiver 30, where it serves as a source of liquid refrigerant for evaporator 41, which continues to operate in refrigeration mode.

Termination of the defrost cycle can be initiated by time if desired, but in the embodiment shown, thermostat 82 switches when the evaporator begins to heat up after the ice has melted. When this occurs, contact **82*b* will be connected to power line 70, and reset solenoid 85 will be energized to reset switches 76 and 77. Alternatively, in the event of abnormally high pressure in line 16, pressure limit switch 65 would close contact 65*a* which would also energize reset solenoid 85**.

When switches 76 and 77 are reset, relay driver R3 is de-energized, which removes power from the three-way diverter valve so that valves 13 and 50 return to their respective positions for refrigeration mode. Contacts R2 return to their normally closed position, but solenoid 26 is delayed by device 102. In the state just described, liquid refrigerant begins to flow through evaporator 40. TEV 34 will be wide open because of the hot condition of sensing bulb 38, and the liquid refrigerant will immediately flow into the evaporator 40. Since it is also very hot the liquid refrigerant will boil immediately and begin to cool the evaporator, the suction line and the sensing bulb. Since liquid line shutoff valve 25 remains closed, there is a limited supply of liquid refrigerant to feed into evaporator 40, i.e., namely the refrigerant which partially fills defrost receiver 30. This is intentionally done to avoid flood back of liquid refrigerant which would otherwise occur into suction line 11. If valve 25 was opened at the same time that diverter valve 50 returned to refrigeration position, a large supply of liquid refrigerant would be available for feeding evaporator 40. Due to the thermal inertia of sensing bulb 38 and TEV 34, there is a danger that an appreciable amount of liquid could pass completely through evaporator 40 and into the suction line before the TEV would be able to react and close off the flow. Liquid in the suction line could severely damage the compressors. To avoid this problem, the prior art has required accumulators in the suction line to separate the liquid refrigerant. With the delayed turn on of the liquid line shutoff valve in the present invention, the slug back problem is eliminated and there is no need to rely on an accumulator in the suction line for this purpose. However, if desired, an accumulator can be used in the suction line as a safety backup device to prevent against valve failure or the like.

At the end of the time delay period of device 102, the circuit is closed to energize solenoid 26 to open the liquid line, assuming that thermostat 96 is closed as may be the case at the end of a defrost cycle. Normal refrigeration mode then resumes, until the defrost time for evaporator 41 comes due, in which case switches 78 and 79 are closed and the process described above is repeated for defrosting that evaporator.

In the case of more than two evaporators, additional circuits would be provided for initiating defrost cycles, although a two stage control could be used for groups of evaporators in larger multiple systems, for example two on two defrosting, etc.

Figure 3:
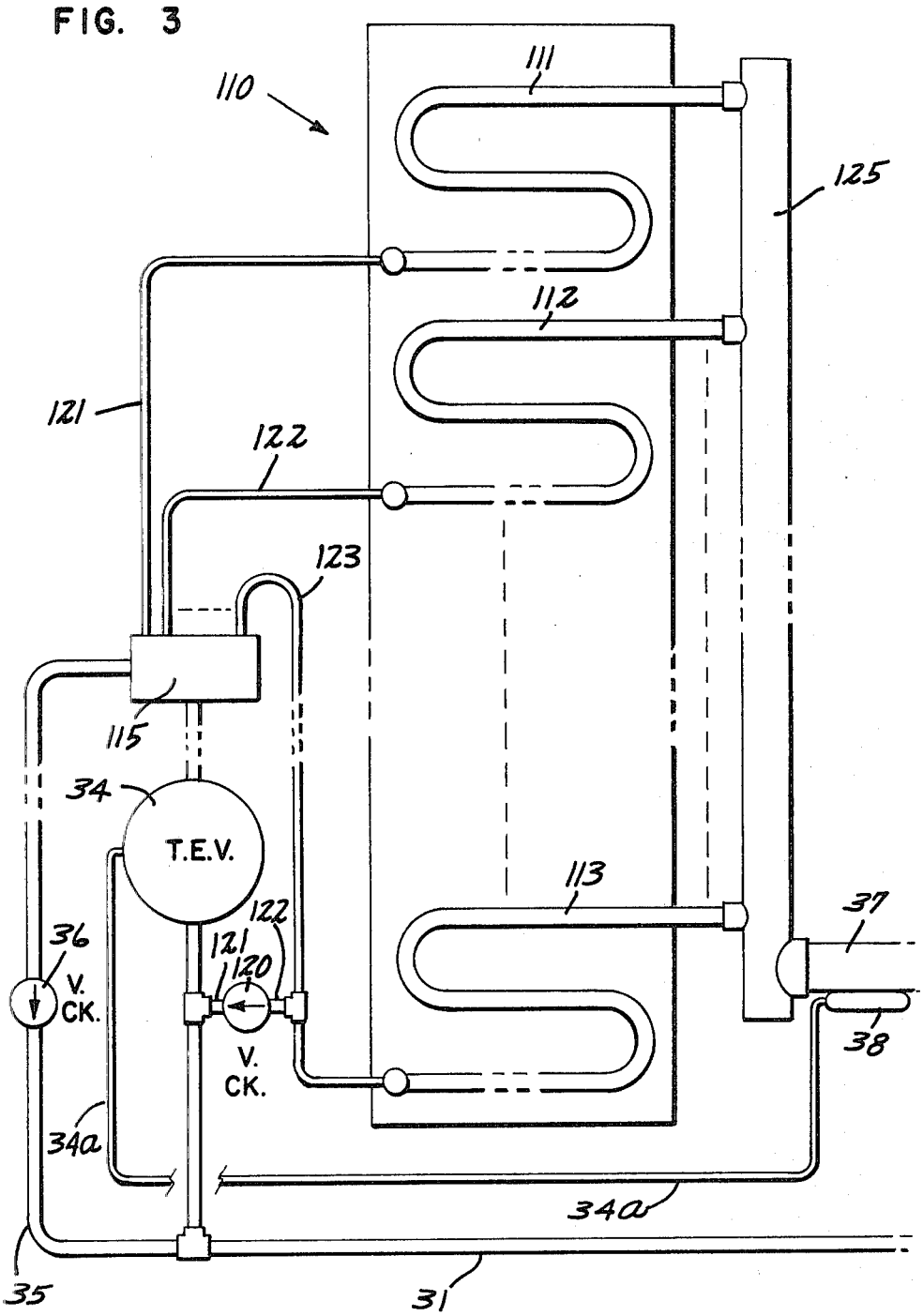
FIG. 3 is a diagram illustrating a preferred refrigerant circuiting and valving path in an evaporator for improved efficieny of defrosting.

For maximum efficiency in the defrosting process, certain modifications to the normal refrigerant circuiting path in the evaporators are recommended. In FIG. 3, reference number 110 generally designates an evaporator, and reference numbers 111, 112, and 113 designate in schematic form individual refrigerant paths or circuits through the evaporator. It will be understood that in practice any number of such paths may be present, but only three are shown for purposes of illustration. Path 113 represents the lowest positioned circuit or group of circuits in the evaporator.

A liquid line such as liquid line 31 bring refrigerant to TEV 34, which connects via capilary tube **34*a* to sensing bulb 38 in contact with the suction line 37. TEV 34 connects to a distributor manifold 115 which has a number of distributing tubes 121, 122, 123, corresponding to the individual circuits in the evaporator. On the other side, the individual circuits connect to a manifold 125, which in turn connects to suction line 37. For defrost mode, branch 35 and check valve 36 are provided so that condensed refrigerant can move from manifold 115 to liquid line 31** during defrost mode.

For a number of reasons, defrosting takes place fastest in the upper regions of the evaporator, and towards the side of the evaporator that receives the hot gas. In FIG. 3, this would means that defrosting would occur more rapidly towards the top and towards the right side of the evaporator. With some types of evaporators in the past, it has been noted that the lowermost and liquid side (corresponding to the left side in FIG. 3) were very difficult to defrost, greatly lengthening the necessary time for the defrost cycle. Several factors contribute to this inherent poor defrosting distribution across the evaporator. One factor is the static head difference between the upper and lower circuits due to the vertical height of the unit. Since the manifold distributing lines 121, 122, and 123 are much smaller in diameter than the rest of the liquid lines and coils, pressure differences can cause a significant difference in the rates of flow of refrigerant therethrough. As gas moves into the evaporator from the manifold 125 and liquid moves out of the evaporator circuits through the tubes 121–123, the flow rate will be faster through the uppermost circuits than through the lowermost circuits due to the static head difference.

Another factor is the heat convection of the air in close contact with the coils of the evaporator. As the evaporator heats up during defrost, the heated air moves towards the top of the evaporator, increasing the melt rate at the top, but not at the bottom of the evaporator.

Another factor is heat convection within the refrigerant tubes themselves, as in manifold 125, which may send the hottest gas to the top circuits rather than to the lower circuits.

As mentioned above, the net result is to provide faster defrosting at the top than at the bottom. To solve this problem, an additional refrigerant path including check valve 120 and conduits 121 and 122 is provided as a return path for refrigerant from the lowest circuit 113. This path is shorter and of larger diameter than distribution tube 123. This path connects from the distribution tube 123 at a point near the connection to the evaporator, to liquid line 31 below the TEV. Of course the check valve is necessary to prevent flow in the wrong direction during normal refrigeration. This additional path provides a liquid flow path with less resistance because of larger diameter, shorter distance, and a lower elevation and therefore with less static head disadvantage. In this manner, refrigerant flow during defrost is speeded up through the lowest circuit 113 to offset the above-noted effects which would otherwise lead to slow defrosting of the low part of the evaporator. As mentioned above, depending upon the individual evaporator design, more than one of the lowest circuits could be so connected through conduits and check valves at a low point to speed up defrosting.

An important benefit provided by the present invention is energy efficiency during defrost. The defrost is essentially "free" in that all of the compressor energy is going into providing refrigeration at the same time that defrosting is taking place. With electric defrost and with conventional hot gas defrosting, refrigeration stops during the defrost cycle, but the energy draw from the compressor continues at a higher rate, with the result that defrosting often requires 10 to 15 percent of the total system energy. Another advantage of the present invention is fast defrost, in the range of 6 to 12 minutes as compared to perhaps double that time for electric defrost.

A further advantage of the present invention is providing a relatively constant freezer temperature. Since the majority of cooling continues during defrost, there is negligible warmup of the refrigerated box or space during defrost. This is beneficial to the product being maintained in the cooled space, and it also minimizes the amount of frost buildup on the walls, ceiling, etc. of the freezer walls due to changing dew points normally associated with box warmup during defrost.

What is claimed is:

1. A defrost control system for a refrigeration system of the type which includes a compressor, a condenser, a plurality of evaporators, and interconnection means connected therewith to form refrigerant flow paths therethrough, comprising:

liquid line valve means operable to selectively open or close the refrigerant path from the condenser to the evaporators;

diverting valve means operable to selectively divert hot gas from the compressor through at least one evaporator in a defrost cycle;

said liquid line valve means and said diverting valve means defining a defrost loop including a hot gas path to at least one defrosting evaporator and a liquid refrigerant path from the defrosting evaporator to at least one evaporator which remains in refrigerating mode; and control means operable in the defrost cycle to open said liquid line valve means to assure excessive refrigerant charge in the defrost loop, then to close said liquid line valve means to allow the system to pump down to a predetermined amount of refrigerant charge in the defrost loop, and then operable to operate said diverting valve means to establish refrigerant flow through said defrost loop.

2. A defrost control system for a refrigeration system of the type which includes a compressor, a condenser, a plurality of evaporators, and interconnection means connected therewith to form refrigerant flow paths therethrough, comprising:

liquid line valve means operable to selectively open or close the refrigerant path from the condenser to the evaporators;

a defrost receiver connected between said liquid line valve means and said evaporators;

diverting valve means operable to selectively divert hot gas from the compressor through at least one evaporator in a defrost cycle;

said liquid line valve means and said diverting valve means defining a defrost loop including a hot gas path to at least one defrosting evaporator and a liquid refrigerant path from the defrosting evaporator through said defrost receiver to at least one evaporator which remains in refrigerating mode, said defrost receiver providing a storage place for liquid refrigerant remaining in the defrosting evaporator at initiation of the defrost cycle and liquid refrigerant condensed during defrost and providing liquid refrigerant to an evaporator remaining in refrigerating mode; and control means operable in the defrost cycle to close said liquid line valve means to allow the system to pump down to a predetermined amount of refrigerant charge in the defrost loop, and then operable to operate said diverting valve means to establish refrigerant flow through said defrost loop.

3. Apparatus according to claim 1 or 2 wherein said control means is operable to operate said diverting valve means after a predetermined pump down time period after closing said liquid line valve means.

4. Apparatus according to claim 1 wherein said control means is operable to open said liquid line for a predetermined time period prior to closing said liquid line for pump down.

5. Apparatus according to claim 1 or 2 wherein said control means is further operable at the end of a defrost cycle to return said diverting valve means to refrigeration position and to delay opening of said liquid line valve means to prevent flood back of liquid refrigerant to the compressor.

6. Apparatus according to claim 1 or 2 wherein said control means includes timing means connected to initiate defrost cycles on predetermined time intervals.

7. Apparatus according to claim 1 or 2 wherein said control means includes evaporator thermostats connected for terminating defrost cycles.

8. Apparatus according to claim 1 or 2 wherein said control means includes pressure responsive means operative to terminate defrost cycles in response to a predetermined discharge pressure.

* * * * *